United States Patent [19]

Iijima et al.

[11] 4,240,883

[45] Dec. 23, 1980

[54] METHOD FOR ELECTROLYSIS OF AN AQUEOUS ALKALI METAL CHLORIDE SOLUTION

[75] Inventors: Tokuzo Iijima, Kobe; Yasushi Samejima, Kakogawa; Kazuo Kishimoto; Takamichi Komabashiri, both of Takasago; Toshiji Kano, Kobe, all of Japan

[73] Assignee: Kanegafuchi Kagaku Kogyo Kabushiki Kaisha, Osaka, Japan

[21] Appl. No.: 104,774

[22] Filed: Dec. 18, 1979

[30] Foreign Application Priority Data

Dec. 28, 1978 [JP] Japan ..... 53-163591

[51] Int. Cl.[3] ..... C25B 1/34

[52] U.S. Cl. ..... 204/98; 204/128

[58] Field of Search ..... 204/98, 128

[56] References Cited

U.S. PATENT DOCUMENTS

| | | | |
|---|---|---|---|
| 3,976,556 | 8/1976 | De Nora | 204/262 |
| 4,025,405 | 5/1977 | Dotson et al. | 204/98 |
| 4,100,050 | 7/1978 | Cook, Jr. et al. | 204/98 |
| 4,101,395 | 7/1978 | Motani et al. | 204/98 |

*Primary Examiner*—R. L. Andrews

*Attorney, Agent, or Firm*—Armstrong, Nikaido, Marmelstein & Kubovcik

[57] ABSTRACT

Method for electrolysis of an aqueous alkali metal chloride solution is provided, wherein an aqueous alkali metal chloride solution is electrolyzed by maintaining a temperature of an aqueous alkali metal hydroxide liquor in a cathode compartment lower than that of the aqueous alkali metal chloride solution in an anode compartment, using an electrolytic cell which is separated by a cation exchange membrane into the anode compartment and the cathode compartment. Not only is current efficiency improved without adverse effects on voltage, thus enabling a long period operation with low electric power consumption, but also high purity alkali metal hydroxide containing a reduced amount of chloride ion is produced.

5 Claims, No Drawings

METHOD FOR ELECTROLYSIS OF AN AQUEOUS ALKALI METAL CHLORIDE SOLUTION

DETAILED DESCRIPTION OF THE INVENTION

The present invention relates to a method for electrolysis of an aqueous metal chloride solution using a cation exchange membrane to produce chlorine and a high purity alkali metal hydroxide at low electric power consumption by electrolysis of an aqueous alkali metal chloride solution.

As a method for producing an alkali metal hydroxide and chlorine by electrolysis of an aqueous alkali metal chloride solution, there have been known mercury methods and diaphragm methods.

In recent years, environmental pollution owing to mercury has come to fore, and thus mercury methods are being replaced with diaphragm methods as electrolysis methods of aqueous alkali metal chloride solutions.

An alkali metal hydroxie obtained by the diaphragm methods, however, is normally rather heavily contaminated with chloride ion, which is a great disadvantage of the diaphragm methods for production of an alkali metal hydroxide. Recently, ion exchange membrane electrolysis methods are proposed using cation exchange membranes, in the place of the diaphragm methods. The ion exchange membrane methods reduce transference of chloride ion so that an alkali metal hydroxide containing a reduced amount of chloride ion is produced. In the electrolysis method of alkali metal chlorides, nevertheless, the low content of chloride ion in the product alone is not the requisite. In view of the present high energy costs, electrolysis with low electric power consumption is strongly desired in particular. Accordingly, there is a great need for an improved electrolysis methods of an aqueous alkali metal chloride solution which not only produces a high purity alkali metal hydroxide but is also capable of operating over a long period of time at low electric power consumption.

An object of the present invention is to provide an improved electrolysis method which improves current efficiency without adverse effects on voltage, thus resulting in a long period of operation with low electric power consumption.

Another object of the present invention is to provide an electrolysis method which produces a high pure alkali metal hydroxide containing a reduced amount of chloride ion.

In view of the foregoing, the present inventors have made an extensive series of study and have arrived at the present invention which provides an improved novel electrolysis method of an aqueous alkali metal chloride solution capable of achieving the foregoing objects. The present invention is to provide an electrolysis method which comprises carrying out electrolysis of an aqueous alkali metal chloride solution by maintaining a temperature of an aqueous alkali metal hydroxide liquor in a cathode compartment lower than that of the aqueous alkali metal chloride solution in an anode compartment, using an electrolytic cell which is separated by a cation exchange membrane into the anode compartment and the cathode compartment. The present invention improves current efficiency without adverse effects on voltage, thus enabling operation over a long period of time at low electric power consumption. The present invention further produces a high purity alkali metal hydroxide containing a low amount of chloride ion.

When an aqueous alkali metal hydroxide is produced by electrolysing an aqueous alkali metal chloride solution, it is known that current efficiency loss takes place due to the back diffusion of $OH^-$ (hydroxyl ion) through the membrane from the catholyte. Back diffusion of $OH^-$ is a function of temperature of the solutions and it increases to lower current efficiency as the temperature is elevated. Hence, loss of current efficiency is reduced by maintaining the temperatures of solutions at low temperatures. Electric power consumption is, notwithstanding, decided upon by current efficiency and cell voltage, and thus efforts of enhancing current efficiency and lowering voltage have to be made. Cell voltage is a reciprocal relation with the temperatures of solutions, and thus it lowers with the temperatures of solutions elevated. In a conventional electrolysis method using ion exchange membranes, the temperatures of the anode and the cathode compartments are usually the same, or else, the temperature of the cathode compartment is higher by about 1° to 2° C. than that of the anode compartment. The reasons are as follows:

Normally, in the electrolysis using a cation exchange membrane, the following electrochemical reactions take place in the cathode and the anode compartments;

Cathode compartment $$H_2O \xrightarrow{e^-} OH^- + \tfrac{1}{2}H_2 \uparrow$$

Anode compartment $$Cl^- \xrightarrow{-e^-} \tfrac{1}{2}Cl^2 \uparrow$$

In this case, overvoltage of the cathode is larger than that of the anode, and thus the heat evolution is larger on the cathode than the anode. Moreover, retention time in the cell of the catholyte is normally so longer than that of the anolyte that cooling effect resulting from the solutions is larger in the anode compartment than in the cathode compartment. The foregoing reasons unavoidably lead to the same temperatures of the anode and the cathode compartments, or rather a high temperature of the cathode compartment than that of the anode compartment. Accordingly, in the conventional electrolysis methods, when the temperatures of the anode and the cathode compartments are elevated, cell voltage lowers but current efficiency disadvantageously decreases as well. Inversely, the temperatures of the anode and the cathode compartments are allowed to lower, current efficiency rises with the undesired increase of cell voltage.

The study has been made by the present inventors on the dependence of current efficiency and voltage upon each temperature of the cathode and the anode compartments, and it has now been discovered that low electric power consumption resulted from high current efficiency and low voltage can be achieved by carrying out electrolysis at a lower temperature maintained of the aqueous alkali metal hydroxide liquor in the cathode compartment than that of the aqueous alkali metal chloride solution in the anode compartment.

In the present invention, the aqueous alkali metal chloride anolyte solutions is in contact with the one side of the cation exchange membrane and the alkali metal hydroxide liquor is in contact with the other side of the membrane. At the steady state of operation, there is contained in the anolyte alkali metal chloride in such a high concentration as to maintain a high chloride ion concentration at the anode, and the catholyte contains a desired concentration of alkali metal hydroxide within below about 50 weight percent, preferably, between about 10 to 45 weight percent.

The anolyte is maintained at a temperature between 50° to 95° C., preferably, 70° to 90° C. and the catholyte is desirably maintained at a lower temperature by about 1° to about 30° C., more desirably, about 5° to about 20° C. than the temperature of the anolyte as aforesaid. In case where the temperature of the catholyte is lower by about 1° to about less than 5° C., or about more than 20° C. to about 30° C., improvement either in current efficiency or in voltage is attained, as compared with any conventional process. More effective results are obtained only where the temperature of the catholyte is lower than that of the anolyte by about 5° C. to about 20° C., providing an outstanding reduced power consumption as compared with the conventional process. When the difference of the temperatures exceeds about 30° C., the increase in voltage excels the improvement in current efficiency, thus leading to the increased power consumption.

The cation exchange membrane used for the present invention includes a fluorinated membrane conveying cation exchange groups such as a perfluorosulfonic acid perfluorocarbon polymer membrane, which is sold under the trademark "Nafion" by E. I. Du Pont de Nemours & Company. The perfluorosulfonic acid perfluorohydrocarbon polymer membrane used in the Examples described later has the following structure:

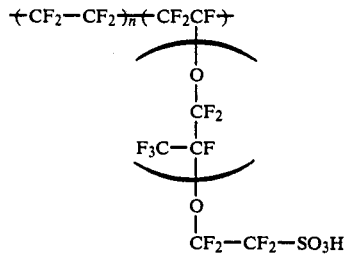

in which the concentration of exchange groups are described as about 1,100 to 1,500 g of dry membrane per an equivalent of $SO_3^-$ exchange groups. Such cation exchange membranes may be also employed as having weak acid groups of carboxylic acid, phosphoric acid and the like, solely or in combination of sulfonic acid aforesaid.

The electrolytic cell used in the present invention is not specifically limited and any filter press type cell or finger type cell, well-known to the art, and the like are employed. When the present invention is applied to a finger type cell, a cation exchange membrane had best be installed to the cell in such a manner as disclosed in Japanese Publication (non-examined) No. 100,952/1979.

The cathode portion material used suitably in the present invention is an electroconductive material resistant to catholyte such as iron, steel, nickel or an alloy thereof, and the shape of the cathode is, for example, an expanded metal mesh, a metal plate having perforations or slits, rods and the like.

The anode portion material used suitably in the present invention is an anolyte-resistant valve metal such as titanium, tantalum, zirconium, tungsten and the like. A valve metal serving as the anode includes platinum group metals, mixed oxides of valve metals and platinum group metals, and the like. The anode may be in various shapes such as an expanded metal mesh, a metal plate having perforations or slits, rods and the like.

The material of which the electrolytic cell is composed includes any material known as suitable to the art. The cathode compartment may be also composed of plastic materials such as chlorinated polyvinyl chloride, polypropylene and the like, since the cathode compartment in the present invention is maintained at a lower temperature than conventional processes. Metallic materials such as iron, steel and the like may be of course employed.

The anode compartment may be composed of an anolyteresistant metallic material such as titanium, non-metallic material such as chlorinated polyvinyl chloride, or a metallic material lined with titanium or a chlorine-resistant non-metallic material.

The operation conditions of the present invention may be accomplished by any process well known to the art, wherein the temperature of the catholyte in the cathode compartment is maintained lower than that of the anolyte in the anode compartment by about 1° to about 30° C. A process may be effectively adopted wherein the catholyte and the anolyte solutions are removed respectively from the cell, then passed through a heat-exchange to control the temperature of each solution to a desired temperature, thereafter recycled back to the anode and the cathode compartments, respectively. Another process may be effective wherein on the frame or walls forming the cathode compartment is a pipe positioned, through which cooling water is passed to eliminate heat from the cathode compartment. It is also a process adopted suitably that a fan is located on the frame or the walls of the cathode compartment, through which a larger amount of heat is removed from the cathode compartment than the anode compartment.

The present invention will be explained by way of examples that follow, which examples are not to be construed in any manner to be limiting of the invention.

EXAMPLE 1

A filter press electrolytic cell composed of a heatresistant vinyl chloride resin was employed. A dimensionally stable electrode made of titanium coated with $TiO_2$—$RuO_2$ thin film was used to serve as an anode. As a cathode, was an iron mesh electrode used. As a cation exchange membrane, "Nafion #315", produced and sold under the trademark by E. I. Du Pont de Nemours & Company, was employed. The effective area of membrane was 1 $m^2$ (1 m × 1 m). Saturated brine was electrolysed under the conditions wherein the brine concentration was 300 g/l, the brine pH was 3, current density was 25 A/$dm^2$, and the concentration of sodium hydroxide produced was 17.5%. The catholyte and anolyte solutions were removed and introduced into heat-exchangers, respectively, where solutions were heat-exchanged with a cooling medium or a heating medium, respectively, to control to the desired temperatures, then recirculated into the respective compartment. A stainless heat-exchanger of plate type was used for the catholyte, and for the anolyte was a titanium-paradium alloy heat-exchanger of plate type employed. The results were given in Table 1.

TABLE 1

| | | Anode comp. temp. (°C.) | Cathode comp. temp. (°C.) | Voltage (V) | Current efficiency (%) | Electric power cost (DCKWH/97% NaOH ton) |
|---|---|---|---|---|---|---|
| Comparative Examples | 1 | 90 | 90 | 3.30 | 82.0 | 2,616 |
| | 2 | 80 | 80 | 3.45 | 84.0 | 2,670 |
| | 3 | 70 | 70 | 3.60 | 87.0 | 2,690 |
| | 4 | 85 | 50 | 3.68 | 88.3 | 2,710 |
| Examples | 1 | 90 | 88 | 3.30 | 82.5 | 2,601 |
| | 2 | 90 | 85 | 3.31 | 83.2 | 2,586 |
| | 3 | 85 | 75 | 3.40 | 87.0 | 2,541 |
| | 4 | 85 | 65 | 3.50 | 87.5 | 2,600 |
| | 5 | 85 | 60 | 3.55 | 87.8 | 2,629 |
| | 6 | 85 | 55 | 3.62 | 88.0 | 2,674 |

EXAMPLE 2

To a finger type electrolytic cell, a cation exchange membrane "Nafion #315", produced and sold under the trademark by E. I. Du Pont de Nemours & Company, was installed. The installation of membrane to the cell was effected in a manner wherein the upper and lower surfaces of cathodes were covered with membrane installation frames, cylindrically formed membranes were positioned substantially parallel to the vertical surfaces of the cathodes, then the membranes were secured to the membrane installation frames by mechanical means of bolts and clips. Expandable dimensionally stable anodes of $TiO_2$—$RuO_2$ thin film coated titanium were employed. Saturated brine was electrolysed under the operating conditions wherein the concentration of brine fed was 300 g/l, pH of brine was 3, current density was 23.5 A/dm$^2$, sodium hydroxide concentration obtained was 17.5%. Brine was supplied while heating into the anode compartment and the cathode compartment was cooled with cooling water, thereby maintaining the solutions at desired temperatures, respectively. The obtained results were shown in Table 2.

Table 2

| | | Anode comp. temp. (°C.) | Cathode comp. temp. (°C.) | Voltage (V) | Current efficiency (%) | Electric power cost (DCKWH/97% NaOH ton) |
|---|---|---|---|---|---|---|
| Comparative Examples | 5 | 90 | 90 | 3.29 | 82.2 | 2,602 |
| | 6 | 80 | 80 | 3.43 | 84.5 | 2,638 |
| | 7 | 70 | 70 | 3.58 | 87.5 | 2,659 |
| | 8 | 85 | 50 | 3.65 | 89.0 | 2,666 |
| Examples | 7 | 90 | 88 | 3.29 | 82.5 | 2,593 |
| | 8 | 90 | 85 | 3.30 | 83.6 | 2,566 |
| | 9 | 85 | 75 | 3.39 | 87.6 | 2,516 |
| | 10 | 85 | 65 | 3.48 | 88.2 | 2,565 |
| | 11 | 85 | 60 | 3.53 | 88.7 | 2,587 |
| | 12 | 85 | 55 | 3.59 | 88.9 | 2,625 |

It is understood from the results of Table 1 and Table 2 that the present invention enables the operation at low electric power consumption. Moreover, the present invention produced a high purity alkali metal hydroxide containing a reduced content of chloride ion.

What is claimed is:

1. Method for electrolysis of an aqueous alkali metal chloride solution which comprises carrying out electrolysis by maintaining a temperature of an aqueous alkali metal hydroxide liquor in a cathode compartment lower than that of the aqueous alkali metal chloride solution in an anode compartment, using an electrolytic cell which is separated by a cation exchange membrane into the anode compartment and the cathode compartment.

2. Method of claim 1, wherein electrolysis is effected in which the temperature of the aqueous alkali metal hydroxide liquor in the cathode compartment is maintained lower by about 1° to about 30° C. than that of the aqueous alkali metal chloride solution in the anode compartment.

3. Method of claim 2, wherein electrolysis is effected in which the temperature of the aqueous alkali metal hydroxide liquor in the cathode compartment is maintained lower by about 5° to about 20° C. than that of the aqueous alkali metal chloride solution in the anode compartment.

4. Method of claim 1, claim 2 or claim 3, wherein a temperature of the aqueous alkali metal chloride solution in the anode compartment is maintained within the range of from 50° to 95° C.

5. Method of claim 4, wherein the temperature of the aqueous alkali metal chloride solution in the anode compartment is maintained within the range of from 70° to 90° C.

* * * * *